US011033098B2

(12) United States Patent
Dunn

(10) Patent No.: US 11,033,098 B2
(45) **Date of Patent: *Jun. 15, 2021**

(54) BRUSH

(71) Applicant: Richard Ward Couture Styling Ltd, London (GB)

(72) Inventor: Richard Dunn, Harrogate (GB)

(73) Assignee: Richard Ward Couture Styling LTD.

( * ) Notice: Subject to any disclaimer, the term of this patent is extended or adjusted under 35 U.S.C. 154(b) by 303 days.

This patent is subject to a terminal disclaimer.

(21) Appl. No.: 16/087,444

(22) PCT Filed: Mar. 20, 2017

(86) PCT No.: PCT/GB2017/050765

§ 371 (c)(1),
(2) Date: Sep. 21, 2018

(87) PCT Pub. No.: WO2017/163032

PCT Pub. Date: Sep. 28, 2017

(65) Prior Publication Data

US 2019/0110584 A1 Apr. 18, 2019

(30) Foreign Application Priority Data

Mar. 24, 2016 (GB) ..... 1605073

(51) Int. Cl.
*A46B 9/02* (2006.01)
*A46D 1/00* (2006.01)

(52) U.S. Cl.
CPC ..... *A46B 9/023* (2013.01); *A46B 9/025* (2013.01); *A46D 1/0238* (2013.01); *A46B 2200/104* (2013.01)

(58) Field of Classification Search
CPC ..... A45D 24/04; A45D 24/10; A45D 24/16; A46B 9/00; A46B 9/023; A46B 9/025; A46B 2200/104; A46D 1/0238
(Continued)

(56) References Cited

U.S. PATENT DOCUMENTS 531,412 A * 12/1894 Garvey ..... A01K 13/002 119/625
541,883 A * 7/1895 Richmond ..... A01K 13/002 119/625

(Continued)

FOREIGN PATENT DOCUMENTS

CN 2909921 Y 6/2007
CN 203952747 U 11/2014

(Continued)

OTHER PUBLICATIONS

International Search Report, dated May 29, 2017, in PCT/GB2017/050765, filed Mar. 20, 2017.

(Continued)

*Primary Examiner* — Jacqueline T Johanas
*Assistant Examiner* — Thomas Drew Agger
(74) *Attorney, Agent, or Firm* — Dunlap Codding, P.C.

(57) ABSTRACT

A hair brush which has a specific arrangement of rows of substantially elliptical (eg oval) cross-section shaped bristles. Each bristle resembles a blade which has a tendency to flex on its minor axis and resist flexing on its major axis. By arranging such bristles in rows, the direction of flex is controlled, and hair can be moved in different directions to promote detangling but not at the expense of the quality of brushing.

18 Claims, 5 Drawing Sheets

(58) Field of Classification Search
USPC ..... 132/120, 121, 126, 137, 139, 141, 142, 132/160, 901; D4/101, 104, 130–136, D4/138; 15/159.1, 160, 186, 187, 207.2; 119/600, 612, 625, 632
See application file for complete search history.

(56) References Cited

U.S. PATENT DOCUMENTS

| | | | | | |
|---|---|---|---|---|---|
| 2,599,191 | A * | 6/1952 | Meunier | A46B 9/005 | 15/167.1 |
| 2,777,145 | A * | 1/1957 | Krieger | A46B 3/22 | 15/186 |
| 5,802,656 | A * | 9/1998 | Dawson | A46B 9/04 | 15/110 |
| 5,896,614 | A * | 4/1999 | Flewitt | A46B 9/06 | 15/167.1 |
| D451,680 | S * | 12/2001 | Holmes | D4/136 | |
| 6,546,937 | B2 * | 4/2003 | Gueret | A46B 9/021 | 132/218 |
| D545,570 | S * | 7/2007 | White | D4/133 | |
| D569,106 | S * | 5/2008 | Maruyama | D4/100 | |
| 8,595,887 | B2 * | 12/2013 | Hiltmann | A01K 13/002 | 15/187 |
| 9,226,570 | B2 | 1/2016 | Pulfrey | | |
| D793,091 | S * | 8/2017 | Laenner | D4/132 | |
| D839,608 | S * | 2/2019 | Laenner | D4/134 | |
| 2006/0283474 | A1 * | 12/2006 | Anderson | A45D 19/02 | 132/126 |
| 2010/0017991 | A1 * | 1/2010 | Kenna | A46B 9/023 | 15/191.1 |
| 2010/0101594 | A1 | 4/2010 | Pulfrey | | |
| 2013/0312207 | A1 * | 11/2013 | Lim | A46D 3/005 | 15/207.2 |
| 2019/0008332 | A1 * | 1/2019 | Johnstone | A46D 1/0238 | |

FOREIGN PATENT DOCUMENTS

| | | | | |
|---|---|---|---|---|
| DE | 3234014 | A1 * | 3/1984 | A45D 20/38 |
| DE | 10241927 | C1 | 11/2003 | |
| GB | 2447692 | A | 9/2008 | |
| RU | 2555943 | C2 | 12/2010 | |
| WO | 2008117009 | A1 | 10/2008 | |
| WO | WO-2009004945 | A1 * | 1/2009 | A46B 5/00 |
| WO | 2016001658 | A1 | 1/2016 | |
| WO | 2016027251 | A1 | 2/2016 | |
| WO | WO-2018210859 | A1 * | 11/2018 | A46B 9/021 |

OTHER PUBLICATIONS

Writtent Opinion of the International Searching Authority, dated May 29, 2017, in PCT/GB2017/050765, filed Mar. 20, 2017.
Taiwan Search Report dated May 5, 2020, for Taiwan Appl. No. 106105028, filed Feb. 16, 2017.
Russian Search Report dated Mar. 27, 2020, for Russian Appl. No. 2018137188, filed Mar. 20, 2017.

* cited by examiner

BRUSH

CROSS REFERENCE TO RELATED APPLICATIONS/INCORPORATION BY REFERENCE STATEMENT

This application is a US national stage application filed under 35 USC § 371 of International Application No. PCT/GB2017/050765, filed Mar. 20, 2017; which claims priority to EP App No. 1605073.4, filed Mar. 24, 2016. The entire contents of the above-referenced patent applications are hereby expressly incorporated herein by reference.

BACKGROUND

The present disclosure relates to a hair brush.

The current range of brushes available for detangling hair commonly have flexible plastic bristles of differing heights that are arranged in various patterns. This arrangement serves to restrict the number of bristles that are in initial contact with the hair and reduces drag through the tangles. As the tangles progressively loosen, the brush penetrates deeper into the hair and shorter bristles then come into contact with and increase the force on the tangle helping to loosen the tangles. By virtue of their flexibility, the bristles bend rather than pull on the tangle. The main drawback of this is that once the tangles have been brushed out, the brush does not function well as fewer full length bristles are in contact with the hair.

Most plastic bristles used in hair brushes have a round cross-section which means that they flex equally in any direction when applied with equal force. When a round bristle is faced with an obstruction (eg a knot), it flexes in the opposite direction to the path of the brush. This action can cause each knot to simply push onto the next knot. This makes it very difficult to control the hair.

An example from the current range of brushes is the TANGLE ANGEL® brush which has round flexible bristles positioned at different heights. The base of the brush undulates which means that the bristles on the highest plane penetrate the hair before the bristles on the lower planes. This allows knotted hair to be progressively coaxed out without tugging. However the bristles move in the same direction and this can simply push one knot up to the knot below.

WO-A-2016/001658 discloses a hair brush in which flexible bristles narrow progressively from the base towards their free end and are arranged with collinear axes in offset rows.

GB-A-2447692 discloses a hair brush for detangling hair in which long and short flexible bristles are alternately arranged on a concave base to provide dual action detanglement.

BRIEF DESCRIPTION OF THE DRAWINGS

The present disclosure will now be described in a non-limitative sense with reference to the accompanying Figures in which.

DETAILED DESCRIPTION

Figure 1:
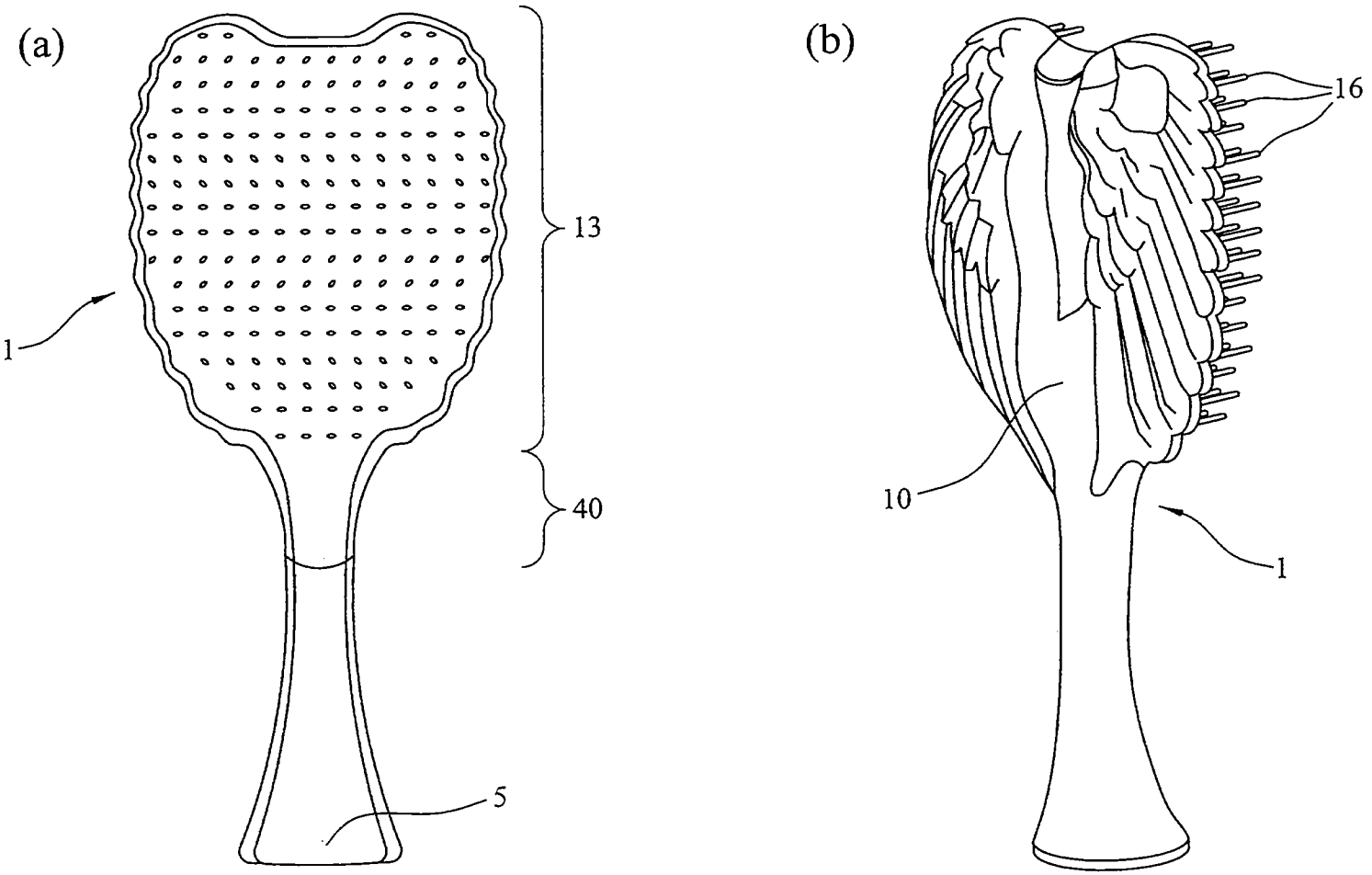
FIG. 1 illustrates a first embodiment of the hair brush of the present disclosure in (a) front view, (b) rear perspective view, (c) front perspective view and (d) side view.
Figure 1:
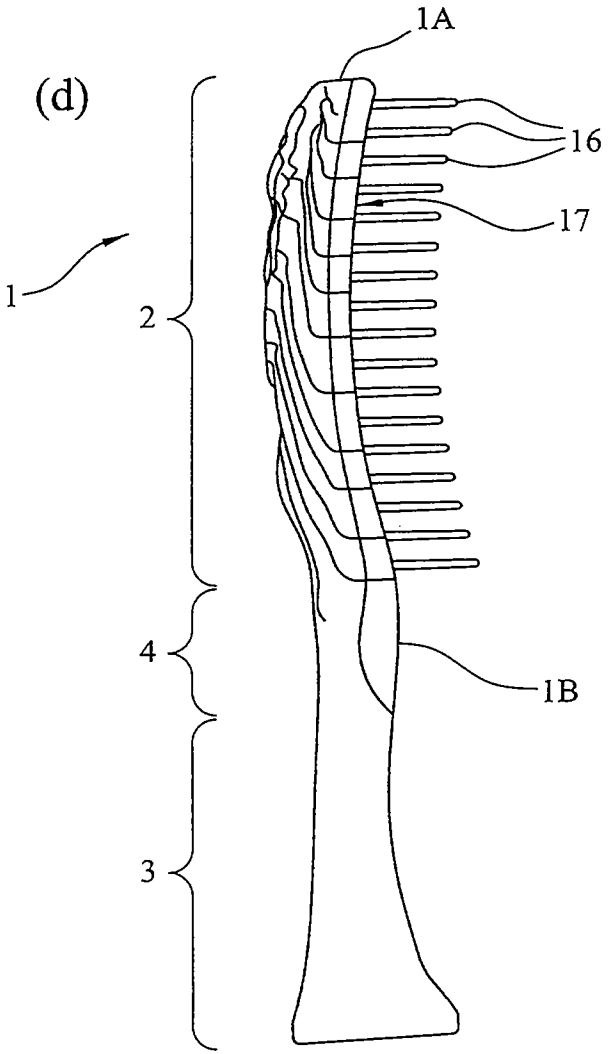
Figure 1:
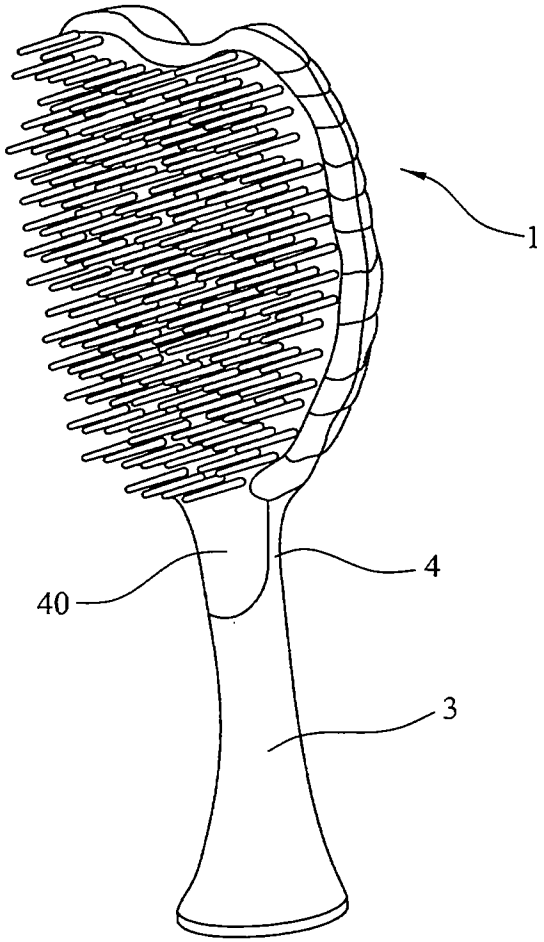

The present disclosure seeks to improve hair brushes by a specific arrangement of certain shaped bristles.

Thus viewed from a first aspect the present disclosure provides a hair brush for detangling hair comprising:

an elongate mounting having a head end and a foot end and defining a longitudinal axis therebetween; and a bristle body mounted on the elongate mounting, the bristle body including a plurality of substantially parallel spaced apart rows of mutually spaced apart upright bristles, wherein each bristle has a cross-section which is at least in part substantially elliptical with a major axis, wherein the plurality of substantially parallel spaced apart rows includes first multiple rows of bristles in which the major axis is substantially perpendicular to the longitudinal axis and second multiple rows of bristles in which the major axis is at an acute or obtuse angle to the longitudinal axis, wherein the first multiple rows are spaced apart singly or jointly by the second multiple rows.

By virtue of its substantially elliptical (eg oval) cross-section, each bristle resembles a blade which has a tendency to flex on its minor axis and resist flexing on its major axis. By arranging such bristles in rows with the major axes disposed in accordance with the present disclosure, the direction of flex is controlled and hair can be moved in different directions to promote detangling but not at the expense of the quality of brushing.

In certain non-limiting embodiments, the acute angle to the longitudinal axis is in the range 30 to 60°, such as (but not limited to) in the range 40 to 50° (eg about 45°).

In certain non-limiting embodiments, the obtuse angle to the longitudinal axis is in the range 120 to 150°, such as (but not limited to) in the range 130 to 140° (eg about 135°).

In certain non-limiting embodiments, the bristles of each of the second multiple rows has a major axis which is at a common acute or obtuse angle to the longitudinal axis.

In certain non-limiting embodiments, amongst the second multiple rows are bristles having a major axis at an acute angle to the longitudinal axis and bristles having a major axis at an obtuse angle to the longitudinal axis.

In certain non-limiting embodiments, the plurality of substantially parallel spaced apart rows are regularly spaced apart.

The plurality of substantially parallel spaced apart rows may further include third multiple rows of bristles in which the major axis is substantially parallel to the longitudinal axis. The first multiple rows may be spaced apart singly or jointly by the second multiple rows and the third multiple rows.

In a particular (but non-limiting) embodiment, the first multiple rows are spaced apart jointly by the second multiple rows. In another particular (but non-limiting) embodiment, the first multiple rows are spaced apart in pairs by the second multiple rows.

In a particular (but non-limiting) embodiment, the first multiple rows are spaced apart singly or jointly by the second multiple rows jointly. In another particular (but non-limiting) embodiment, the first multiple rows are spaced apart singly or jointly by the second multiple rows in pairs. In another particular (but non-limiting) embodiment, the bristles of each of an adjacent pair of second multiple rows has a major axis which is at a common acute or obtuse angle to the longitudinal axis. In yet another particular (but non-limiting) embodiment, the second multiple rows in pairs alternate consecutively between an acute and an obtuse angle to the longitudinal axis.

In a particular (but non-limiting) embodiment, the first multiple rows are spaced apart in pairs by the second multiple rows in pairs. In another particular (but non-limiting) embodiment, the first multiple rows are spaced apart in pairs by the second multiple rows in pairs which alternate consecutively between an acute and an obtuse angle to the longitudinal axis.

In a particular (but non-limiting) embodiment, the first multiple rows are spaced apart singly by the second multiple rows. In another particular (but non-limiting) embodiment, the first multiple rows are spaced apart singly by the second multiple rows singly. In yet another particular (but non-limiting) embodiment, the second multiple rows in singles alternate consecutively between an acute and an obtuse angle to the longitudinal axis.

Typically the plurality of substantially parallel spaced apart rows of mutually spaced apart upright bristles are in registry. For example, the plurality of substantially parallel spaced apart rows of mutually spaced apart upright bristles may define a substantially regular (eg a rectangular or cubic) array.

The elongate mounting may be an elongate shell mounting.

The elongate mounting may comprise a head and neck which extends into an elongate tubular handle.

The elongate mounting may be adapted to be snugly hand-fitted.

The elongate mounting may be paddle-shaped.

The bristle body may be a bristle shell or bristle pad.

The exterior of the bristle body may be contoured, flat, rounded or dimpled. The exterior of the bristle body may be concave.

The bristle body may contain antibacterial or antistatic additives. The bristle body may be heat resistant.

The bristle body may extend along the neck of the elongate mounting.

In certain non-limiting embodiments, the bristle body extends along the elongate tubular handle of the elongate mounting. This is useful where the bristle body has antistatic properties because in contact with a user's hand the bristle body can act as an earthing strip which draws static away from the hair.

In certain non-limiting embodiments, each bristle has a cross-section which at least at or near to its tip is substantially elliptical.

In certain non-limiting embodiments, each bristle has a cross-section which is uniformly substantially elliptical.

Each bristle may be a flexible (eg resiliently flexible) bristle. Each bristle may be a different, similar or the same length.

The tip of a bristle may be domed. The tips of the bristles may define a flat or curved (eg concave) surface.

The hair brush in use is generally drawn through the hair in a direction substantially perpendicular to the longitudinal axis.

The hair brush may be a paddle brush or round brush.

The hair brush may be used for humans or animals (eg pets).

The hair brush may be driven to vibrate in use.

Example 1

Figure 3:
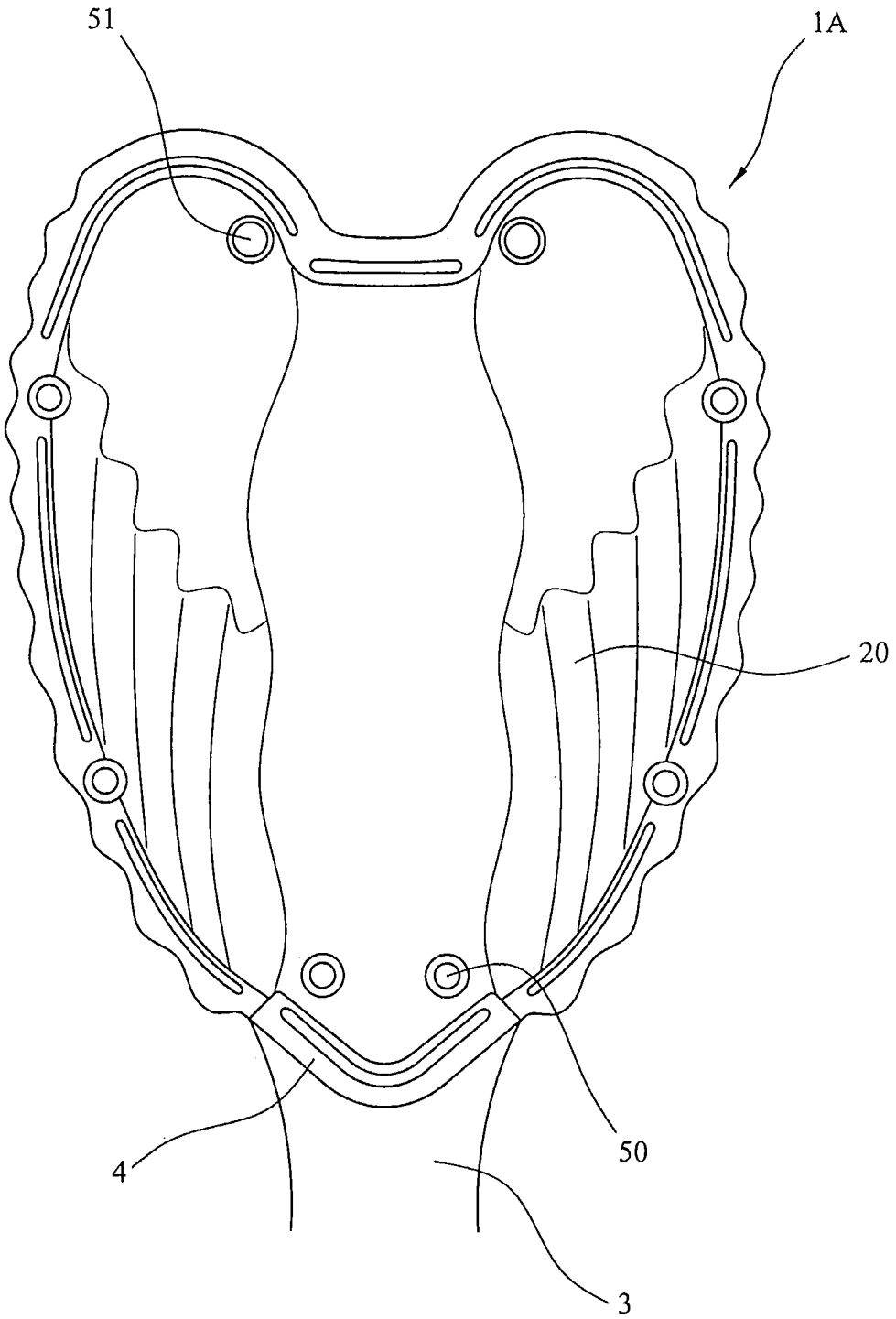
FIG. 3 illustrates the upper part of the paddle-shaped mounting shell of the first embodiment.

A first embodiment of a hair brush 1 of the present disclosure is illustrated in FIGS. 1(*a*) to (*d*). The hair brush 1 is a two-part shell consisting of a paddle-shaped mounting shell 1A on which is mounted a bristle shell 1B. The paddle-shaped mounting shell 1A is composed of polypropylene and its upper part is shown in isolation in FIG. 3. The bristle shell 1B is composed of a thermoplastic elastomer which contains antistatic and antibacterial additives.

The paddle-shaped mounting shell 1A comprises a substantially heart-shaped head shell 2 which at its tail end forms a slender neck shell 4 which extends into an elongate tubular handle 3. The substantially heart-shaped head shell 2 has an ornamental convex exterior face 10 and a shallow concave interior face 20. The elongate tubular handle 3 terminates in a splayed foot 5.

The bristle shell 1B comprises a substantially heart-shaped head shell 13 which at its tail end forms a neck shell 40. The shape of the head shell 13 and neck shell 40 complements the shape of the head shell 2 and neck shell 4 so that the bristle shell 1B and mounting shell 1A are a press-fit. The close proximity of the neck shell 40 to the elongate tubular handle 3 held by a user advantageously serves to electrostatically ground the hair brush 1.

A first end of the bristle shell 1B is anchored internally to the neck shell 4 by a first pair of press-fittings 50 and a second end of the bristle shell 1B is anchored internally at the cusp of the heart-shaped head shell 2 by a second pair of press-fittings 51. Further press-fittings are provided on the edges of the respective paddle-shaped mounting shell 1A and bristle shell 1B. The integrity of the press-fit is enhanced with adhesive.

The bristle shell 1B comprises an array of bristles 16 of the same length which extend from a shallow concave exterior surface 17. Each bristle 16 has a substantially elliptical cross-section. The major axes of the bristles 16 in the array are shown schematically in pattern 1 in FIG. 2 alongside the longitudinal axis of the hair brush 1. In the array, pairs of rows of bristles 16A with major axes perpendicular to the longitudinal axis of the hair brush 1 are flanked by pairs of rows of bristles 16B/16B' with major axes which alternate at about 45°/135° respectively to the longitudinal axis. The pairs of rows of bristles 16A with major axes perpendicular to the longitudinal axis are in the blade position (least flex). The pairs of rows of bristles 16B at about 45°/135° to the longitudinal axis serve to pull hair away from the pairs of rows of bristles 16A.

Comparative Tests

Figure 2:
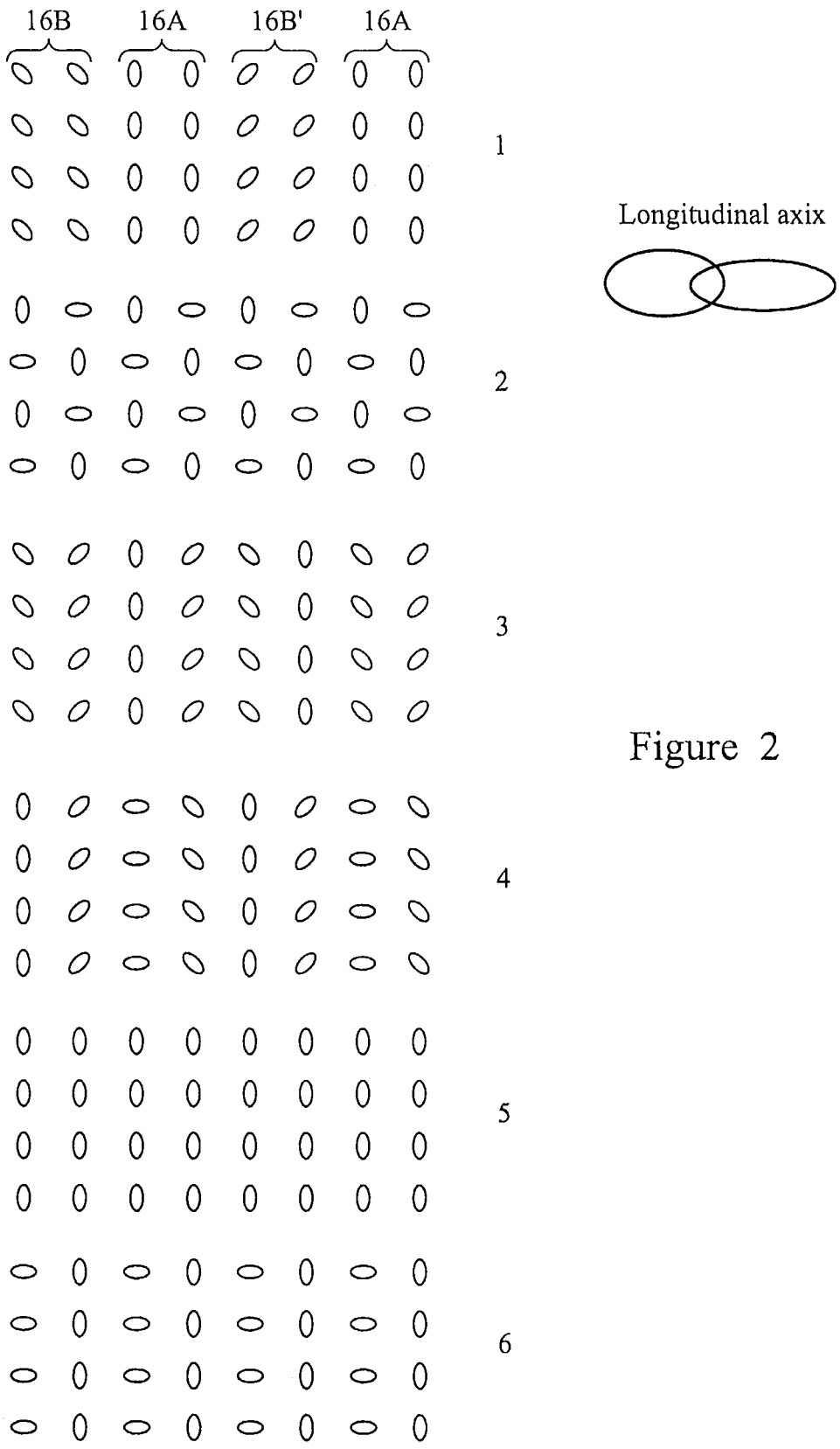
FIG. 2 illustrates the bristle patterns of conventional hair brushes and of embodiments of the present disclosure.

Tests were carried out on hair brushes with bristle patterns 1 to 6 shown relative to the longitudinal axis of the hair brush in FIG. 2. In each case, the bristles were made of the same material with the same flex. The users carried out blind testing and were able to see neither the pattern nor the direction in which the bristles flexed.

Bristle patterns 1, 3 and 4 are bristles patterns of embodiments of the present disclosure. Bristle pattern 5 is the bristle pattern of a conventional hair brush which was tested for comparative purposes. Bristle patterns 2 and 6 were tested for further comparative purposes.

Results

The test showed that bristle pattern 5 was the least effective and least popular for detangling hair. It felt scratchy and struggled to brush through hair without severe tugging.

Bristle pattern 2 has each bristle at opposing right angles to each other. This was disliked. The feedback was that it felt scratchy and pulled the hair.

No relevant feedback was given for pattern 6.

Bristle patterns 1, 3 and 4 stood out as feeling soft and worked well through tangled hair.

Bristle pattern 1 was the favourite. All of the users noted that the brush felt soft and brushed through the knotted hair with less resistance and pulling. The brush was used alongside a conventional TANGLE ANGEL® which has bristles with a round cross-section and was regarded by all of the users as an improvement.

Example 2

Figure 4:
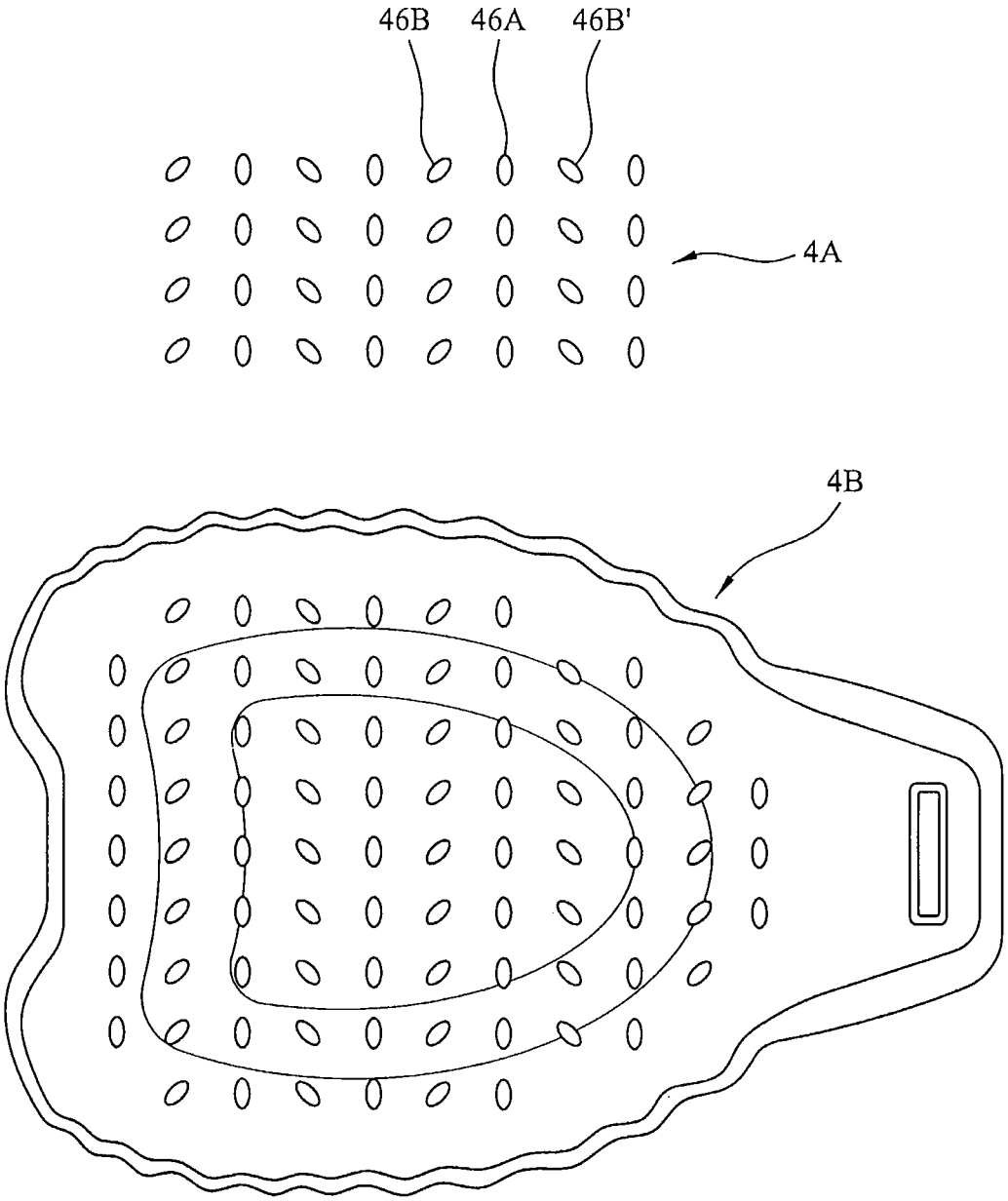
FIG. 4 illustrates a bristle shell of a second embodiment of the hair brush of the present disclosure and its bristle pattern.

FIG. 4 illustrates a bristle shell 4B of a second embodiment of the hair brush of the present disclosure. The bristle shell 4B is largely identical to the bristle shell 1B of the first embodiment but has an array of bristles 4A with a different bristle pattern (as shown). In the array of bristles 4A, a single row of bristles 46A with major axes perpendicular to the longitudinal axis of the hair brush is flanked by single rows of bristles 46B/46B' with major axes which alternate at about 45°/135° respectively to the longitudinal axis.

The invention claimed is:

1. A hair brush for detangling hair comprising:

an elongate mounting having a head end and a foot end and defining a longitudinal axis therebetween; and a bristle body mounted on the elongate mounting, the bristle body including a plurality of substantially parallel spaced apart rows of mutually spaced apart upright bristles, wherein each bristle has a cross-section which is at least in part elliptical with a major axis, wherein the plurality of substantially parallel spaced apart rows includes first multiple rows of bristles in which the major axis is substantially perpendicular to the longitudinal axis and second multiple rows of bristles in which the major axis is at an acute or obtuse angle to the longitudinal axis, wherein the first multiple rows are separated by the second multiple rows into single rows or groups of rows.

2. The hair brush as claimed in claim 1, wherein the acute angle to the longitudinal axis is in the range 40 to 50°.

3. The hair brush as claimed in claim 1, wherein the obtuse angle to the longitudinal axis is in the range 130 to 140°.

4. The hair brush as claimed in claim 1, wherein the bristles of each of the second multiple rows has a major axis which is at a common acute or obtuse angle to the longitudinal axis.

5. The hair brush as claimed in claim 1, wherein amongst the second multiple rows are bristles having a major axis at an acute angle to the longitudinal axis and bristles having a major axis at an obtuse angle to the longitudinal axis.

6. The hair brush as claimed in claim 1, wherein the plurality of substantially parallel spaced apart rows are regularly spaced apart.

7. The hair brush as claimed in claim 1, wherein the first multiple rows are separated by the second multiple rows into groups of rows.

8. The hair brush as claimed in claim 1, wherein the first multiple rows are separated by the second multiple rows into single rows or groups of rows, and wherein the second multiple rows are separated by the first multiple rows into groups of rows.

9. The hair brush as claimed in claim 1, wherein the first multiple rows are spaced apart in pairs by the second multiple rows in pairs.

10. The hair brush as claimed in claim 1, wherein the first multiple rows are separated by the second multiple rows into single rows.

11. The hair brush as claimed in claim 1, wherein each bristle has a cross-section which is uniformly elliptical.

12. The hair brush as claimed in claim 7, wherein the first multiple rows are spaced apart in pairs by the second multiple rows.

13. The hair brush as claimed in claim 8, wherein the first multiple rows are separated by the second multiple rows into single rows or groups of rows, and wherein the second multiple rows are separated by the first multiple rows into pairs.

14. The hair brush as claimed in claim 8, wherein the second multiple rows in pairs alternate consecutively between an acute and an obtuse angle to the longitudinal axis.

15. The hair brush as claimed in claim 13, wherein the bristles of each of an adjacent pair of second multiple rows has a major axis which is at a common acute or obtuse angle to the longitudinal axis.

16. The hair brush as claimed in claim 9, wherein the first multiple rows are spaced apart in pairs by the second multiple rows in pairs which alternate consecutively between an acute and an obtuse angle to the longitudinal axis.

17. The hair brush as claimed in claim 10, wherein the first multiple rows are separated by the second multiple rows into single rows, and wherein the second multiple rows are separated by the first multiple rows into single rows.

18. The hair brush as claimed in claim 17, wherein the second multiple rows in singles alternate consecutively between an acute and an obtuse angle to the longitudinal axis.

* * * * *